US005175591A

United States Patent [19]

Dunn et al.

[11] Patent Number: 5,175,591

[45] Date of Patent: Dec. 29, 1992

[54] CLEANING DEVICE INCLUDING ABRADING CLEANING BRUSH FOR COMET CONTROL

[75] Inventors: Stephen T. Dunn, Webster; John J. Kopko, Macedon, both of N.Y.

[73] Assignee: Xerox Corporation, Stamford, Conn.

[21] Appl. No.: 748,141

[22] Filed: Aug. 21, 1991

[51] Int. Cl.[5] ..... G03G 21/00

[52] U.S. Cl. ..... 355/297; 15/256.52; 355/299; 355/301

[58] Field of Search ..... 355/296, 297, 299, 301, 355/302, 211; 15/256.5, 256.51, 256.52; 118/652

[56] References Cited

U.S. PATENT DOCUMENTS

| | | | |
|---|---|---|---|
| 3,918,808 | 11/1975 | Narita | 355/297 |
| 3,947,108 | 3/1976 | Thettu et al. | 355/297 |
| 4,364,660 | 12/1982 | Oda | 355/297 |
| 4,436,412 | 3/1984 | Yamagata et al. | 15/256.52 X |
| 4,451,139 | 5/1984 | Yanagawa et al. | 355/297 |
| 4,835,807 | 6/1989 | Swift | 15/1.5 R |
| 4,875,081 | 10/1989 | Goffe et al. | 355/303 |
| 4,986,526 | 1/1991 | Dastin | 271/227 |
| 4,989,047 | 1/1991 | Jugle et al. | 355/297 |
| 5,060,014 | 10/1991 | Adachi et al. | 355/211 |

FOREIGN PATENT DOCUMENTS

| | | | |
|---|---|---|---|
| 0134272 | 7/1985 | Japan | 355/297 |
| 0274180 | 11/1989 | Japan | 355/297 |
| 0312578 | 12/1989 | Japan | 355/297 |

OTHER PUBLICATIONS

Crooks, "Brush Material For Cleaning Electrophotographic Plates," *IBM Disclosure Bulletin, vol. 12, No. 7, Dec. 1969, p. 1046.*

*Primary Examiner*—A. T. Grimley
*Assistant Examiner*—Christopher Horgan
*Attorney, Agent, or Firm*—Oliff & Berridge

[57] ABSTRACT

Apparatus for cleaning residual toner from a charge retentive surface is provided with a rotating abrading brush, located upstream of a primary cleaner relative to a feeding direction of the charge retentive surface. The abrading brush contacts and abrades the charge retentive surface. The abrasion of the charge retentive surface reduces the friction between the charge retentive surface and a primary cleaner (which is preferably a cleaning blade biased against the charge retentive surface) and prevents the formation of comets (adhered toner particles) on the charge retentive surface.

20 Claims, 3 Drawing Sheets

CLEANING DEVICE INCLUDING ABRADING CLEANING BRUSH FOR COMET CONTROL

BACKGROUND OF THE INVENTION

1. Field of the Invention

This invention relates to electrophotographic image forming apparatus, and more particularly to cleaning devices for removing residual toner and debris from a charge retentive surface of an image forming apparatus.

2. Description of Related Art

In electrophotographic applications such as xerography, a charge retentive surface of a photoreceptor is electrostatically charged, and exposed to a light pattern of an original image to be reproduced, to selectively discharge the photoreceptive surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as toner. Toner is held on the image areas by the electrostatic charge on the surface. Thus, a toner image is produced in conformity with a light image of the original beam reproduced. The toner image may then be transferred to a substrate (e.g., paper), and the image affixed thereto to form a permanent record of the image to be reproduced. The process is well know, and is useful for light lens copying from an original, and printing applications from electronically generated or stored originals, where a charged surface may be discharged in a variety of ways. Ion projection devices where a charge is imagewise deposited on a charge retentive substrate operate similarly.

Multi-color electrophotographic printing is substantially identical to the foregoing process of black and white printing. However, rather than forming a single latent image on the photoreceptor, successive latent images corresponding to different colors are recorded thereon. Each single color electrostatic latent image is developed with toner of a color complementary thereto. This process is repeated in a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet as described above to create a color copy. The developer material (toner) may be a liquid material or a powder material.

Although, a preponderance of the toner forming the image is transferred to the paper during transfer, some toner invariably remains on the charge retentive surface of the photoreceptor, it being held thereto by relatively high electrostatic and/or mechanical forces. Additionally, paper fibers, toner additives, Kaolins and other debris have a tendency to be attracted to the charge retentive surface. It is essential for optimum imaging that the toner and debris remaining on the surface be cleaned thoroughly therefrom.

Blade cleaning is a highly desirable method for removal of residual toner and debris (hereinafter, collectively referred to as "toner") from a photoreceptor. In a typical application, a relatively thin elastomeric blade member is provided and supported adjacent to and transversely across the photoreceptor surface with a blade edge chiseling or wiping toner from the surface.

Subsequent to release of toner from the surface, the released toner accumulating adjacent to the blade is transported away from the blade area by a toner transport arrangement, or by gravity. Unfortunately, blade cleaning suffers from certain deficiencies, primarily resulting from the frictional sealing contact which must be maintained between the blade and the photoreceptor surface. One common problem is the build up of material on the photoreceptor referred to as "comets". These comet defects are formed from high friction between the cleaning blade and the photoreceptor resulting in small particles becoming permanently attached with high adhesion forces to the photoreceptor. Frequently, toner additives which are not easily removed from the photoreceptor by these cleaning blades are melted by these high frictional forces, and permanently bonded to the photoreceptor. Additional particles continue to accumulate behind the initial "comet heads" and can form a 1-5 millimeter long comet tail attached to the photoreceptor. These comets can cause copy quality defects in the form of spots on the copy sheet in background areas.

FIG. 1 illustrates the manner in which comets are formed on the charge retentive surface of a photoreceptor 20. Photoreceptor 20 moves in the direction indicated by arrow 22. Toner particles 90 remaining on photoreceptor 20 after transfer of the toner image from the photoreceptor to a substrate (paper) are removed from the photoreceptor by a primary cleaning device such as, for example, a cleaning blade 110. Cleaning blade 110 is arranged at a low angle to the photoreceptor 20. Most of the toner particles accumulate upstream of blade 110 in the area denoted by reference numeral 93. This accumulated toner is then transported away by a toner transport arrangement or gravity. However, as illustrated in FIG. 1 the tip of blade 110 can become bent due to the movement of photoreceptor 20, and the high friction forces generated between blade 110 and photoreceptor 20. At this time, some toner particles 91 can become located between the bent portion of blade 110 and the photoreceptor 20, where they are pressed into the photoreceptor with a high force. This causes these toner particles to melt and become permanently attached to the photoreceptor. Additional toner particles build up in front of these bonded toner particles with subsequent photoreceptor rotation and are also pressed into the photoreceptor 20 with a high force, causing the "comet tails" 92 to grow.

Current technology for controlling comets requires the addition of specific additives to the dry ink material that can reduce cometing in specific machine applications. However, additives which work in one type of machine are not necessarily effective in eliminating comets when used with other machines.

Accordingly, a need exists for a photoreceptor cleaning device which prevents comets from forming on the photoreceptor. Preferably, this cleaning device should prevent high friction forces from being generated between a primary cleaning member and the photoreceptor to prevent toner particles from being pressed with high forces against the photoreceptor.

A number of cleaning apparatus for photoreceptors which employ the combination of a brush and a cleaning blade are known.

U.S. Pat. No. 4,989,047 to Jugle et al discloses a photoreceptor cleaning apparatus for the reduction of agglomeration-caused spotting. A thin scraper member arranged at a low angle to the photoreceptor is provided as a secondary cleaning device to a rotating negatively biased fiber brush which contacts the surface of the photoreceptor upstream of the blade to remove most of the adhering toner particles. The rotating brush removes the preponderance of toner from the photoreceptor, and the blade removes any toner agglomerates formed on the photoreceptor by the agglomeration of toner, and toner and debris.

U.S. Pat. No. 4,364,660 to Oda discloses a photoreceptor cleaning system having a cleaning blade which removes toner from a photoreceptor. A fur brush located upstream of the cleaning blade acts as a toner recovery mechanism to recover toner removed from the photoreceptor by the cleaning blade. The brush is made from synthetic resin filaments having a diameter of 0.1 mm. The brush rotates in a direction opposite from the photoreceptor to direct toner toward the blade.

U.S. Pat. No. 4,451,139 to Yanagawa et al discloses a cleaning apparatus for a photoreceptor which includes an elastic polyurethane cleaning blade located downstream of a rotating fur brush with respect to the rotation direction of the photoreceptor.

U.S. Pat. No. 3,918,808 to Narita discloses a photoreceptor developing and cleaning station wherein a cleaning blade is placed in a developing station which uses a magnetic brush to apply toner to a photoreceptor. Two complete revolutions of a photoreceptor are required to perform a single copying operation. During a first revolution, the blade is retracted. After transfer of a toner image from the photoreceptor to a copy sheet, the blade is contacted with the photoreceptor to remove residual toner from the photoreceptor.

U.S. Pat. No. 3,947,108 to Thettu et al discloses a photoreceptor cleaning system wherein a blade acts as a primary cleaning member. A brush located downstream of the blade removes a residual film from the photoreceptor not removed by the blade. The brush is abrasive and made from cotton or plastic fibers.

U.S. Pat. No. 4,875,081 to Goffe et al discloses a blade member for cleaning a photoreceptor wherein an A.C. voltage is applied to the cleaning blade. Use of the A.C. voltage eliminates the need to bias the blade against the photoreceptor with a high frictional force and thus, eliminates impaction of toner on the photoreceptor surface.

U.S. Pat. No, 4,835,807 ;to Swift discloses a cleaning brush for an electrostatographic reproducing apparatus which has electroconductive fibers of nylon filamentary polymer substrate having finely divided electrically conductive particles of carbon black suffused therein.

None of these patents disclose the present invention because they do not provide a rotating brush that abrades a photoreceptor upstream of a primary cleaning device for cleaning the photoreceptor.

OBJECTS AND SUMMARY OF THE INVENTION

It is an object of the present invention to provide a cleaning device for removing residual toner from the charge retentive surface of an image forming apparatus which prevents comets from being formed on the charge retentive surface.

It is another object of the present invention to provide a cleaning device for a charge retentive surface which includes a member for preventing high frictional forces from building up between a primary cleaning member and the charge retentive surface.

To achieve the foregoing and other objects, and to overcome the shortcomings discussed above, a cleaning apparatus is provided with a rotating abrading brush, located upstream of a primary cleaner relative to a feeding direction of the charge retentive surface. The abrading brush contacts and abrades the charge retentive surface. The abrasion of the charge retentive surface reduces the friction between the charge retentive surface and a primary cleaner (which is preferably a cleaning blade biased against the charge retentive surface) and prevents the formation of comets on the charge retentive surface.

The bristles which form the abrading brush are constructed from a material having a hardness greater than the hardness of the charge retentive surface so that the charge retentive surface is scratched by the bristles. The brush is rotated at a speed and contacted with a length of the charge retentive surface which are sufficient to cause scratches which reduce the coefficient of friction between the primary cleaning device and the charge retentive surface, but not so much as to damage the charge retentive surface, or to apply too much pressure to the residual toner particles on the charge retentive surface.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

A. The Image Forming Apparatus

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

In particular, the charge retentive surface cleaning apparatus will be described in combination with a particular color printer that uses a photoreceptor belt having a charge retentive surface. However, the cleaning apparatus of the present invention can be used with any printing apparatus that includes a charge retentive surface, including single color printers. The present invention is particularly applicable to any printer containing a charge retentive surface which is subject to the formation of comets thereon.

Figure 2:
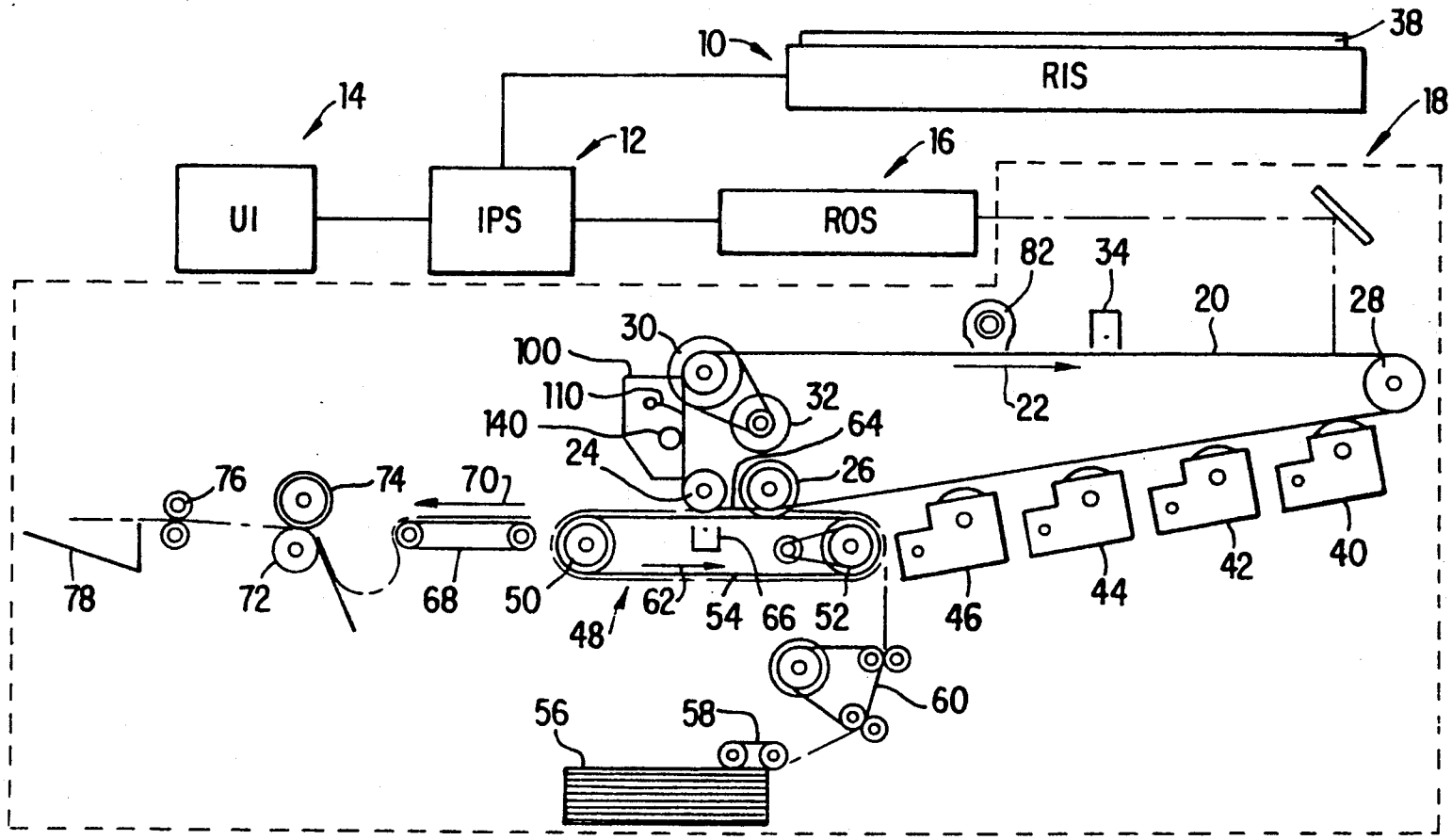
FIG. 2 is a schematic elevational view illustrating an electronic reprographic image forming apparatus incorporating the features of the present invention therein.

For a general understanding of the features of the present invention, reference is made to the drawings. In the drawings, like reference numerals have been used throughout to designate identical elements. FIG. 2 is a schematic elevational view of an illustrative electronic reprographic system incorporating the features of the present invention therein. It will become evident from the following discussion that the present invention is equally well suited for use in a wide variety of printing systems, and is not necessarily limited in its application to the particular system shown herein.

Turning initially to FIG. 2, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e., red, green and blue densities, at each point of the original document. This information is transmitted to an image processing system (IPS), indicated generally by the reference numeral 12. IPS 12 is the control electronics which prepare and manage the image data flow to the raster output scanner (ROS), indicated generally by the reference numeral 16. A user interface (UI), indicated generally by the reference numeral 14, is in communication with the IPS. The UI enables the operator to control the various operator adjustable functions. The output signal from the UI is transmitted to IPS 12. The signal corresponding to the desired image is transmitted from IPS 12 to ROS 16, which creates the output copy image. ROS 16 lays out the image in a series of horizontal scan lines with each line having a specified number of pixels per inch. The ROS includes a laser having a rotating polygon mirror block associated therewith. The ROS exposes the charged photoconductive surface of the printer, indicated generally by the reference numeral 18, to achieve a set of subtractive primary latent images.

The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 2, printer or marking engine 18 is an electrophotographic printing machine. The electrophotographic printing machine employs a photoconductive belt 20. Preferably, the photoconductive belt 20 is an AMAT belt made from a polychromatic photoconductive material. Belt 20 moves in the direction of arrow 22 to advance successive portions of the photoconductive surface sequentially through the various processing stations disposed about the path of movement thereof. Belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through the charging station. At the charging station, a corona generating device, indicated generally by the reference numeral 34 charges photoconductive belt 20 to a relatively high, substantially uniform potential.

Next, the charged photoconductive surface is rotated to the exposure station. The exposure station includes the RIS 10 having a multi-colored original document 38 positioned thereat. The RIS captures the entire image from the original document 38 and converts it to a series of raster scan lines which are transmitted as electrical signals to IPS 12. The electrical signals from the RIS correspond to the red, green and blue densities at each point in the document. The IPS converts the set of red, green and blue density signals, i.e. the set of signals corresponding to the primary color densities of original document 38, to a set of colorimetric coordinates.

The operator actuates the appropriate keys of the UI 14 to adjust the parameters of the copy. UI 14 may be a touch screen or any other suitable control panel, providing an operator interface with the system. The output signals from the UI are transmitted to the IPS. The IPS then transmits signals corresponding to the desired image to ROS 16. ROS 16 includes a laser with rotating polygon mirror blocks. Preferably, a nine facet polygon is used. The RO illuminates the charged portion of the photoconductive belt 20 at a rate of about 400 pixels per inch. The ROS will expose the photoconductive belt to record three latent images. One latent image is adapted to be developed with cyan developer material. Another latent image is adapted to be developed with magenta developer material with the third latent image being developed with yellow developer material. The latent images formed by the ROS on the photoconductive belt correspond to the signals from IPS 12.

After the electrostatic latent image has been recorded on photoconductive belt 20, belt 20 advances the electrostatic latent image to the development station. The development station includes four individual developer units generally indicated by the reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface.

Developer units 40, 42 and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with the blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

Each of the developer units is moved into and out of the operative position. In the operative position, the magnetic brush is closely adjacent to the photoconductive belt, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without co-mingling. In FIG. 2, developer unit 40 is shown in the operative position with developer units 42, 44 and 46 being in the non-operative position.

After development, the toner image is moved to the transfer station where the toner image is transferred to a sheet of support material, such as, for example, plain paper. At the transfer station, the sheet transport apparatus, indicated generally by the reference numeral 48, moves the sheet into contact with photoconductive belt 20. Sheet transport 48 has a pair of spaced belts 54 entrained about rolls 50 and 52. A gripper extends between belts 54 and moves in unison therewith. The sheet is advanced from a stack of sheets 56 disposed on a tray. A friction retard feeder 58 advances the uppermost sheet from stack 56 onto a pre-transfer transport 60. Transport 60 advances the sheet to sheet transport 48. The sheet is advanced by transport 60 in synchronism with the movement of the gripper. In this way, the leading edge of the sheet arrives at a preselected position, i.e. a loading zone, to be received by the open gripper. The gripper then closes securing the sheet thereto for movement therewith in a recirculating path. The leading edge of the sheet is secured releasably by the gripper. Further details of a method of calibrating the registration of the sheet with the gripper can be found in U.S. Pat. No. 4,986,526 to Richard M. Dastin, the disclosure of which is incorporated herein by reference.

As the belts move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the gripper so as to move in a recirculating path for three cycles. In this way, three different color toner images are transferred to the sheet in superimposed registration with on another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner which is transferred, in superimposed registration with one another, to the sheet to form the multi-color copy of the colored original document.

After the last transfer operation, the grippers open and release the sheet. Conveyer 68 transports the sheet, in the direction of arrow 70, to the fusing station where the transferred image is permanently fused to the sheet. The fusing station includes heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by forwarding roll pairs 76 to catch tray 78 for subsequent removal therefrom by the machine operator.

The last processing station in the direction of movement of belt 20, as indicated by arrow 22, is the cleaning station 100. Further details of the cleaning station will be discussed hereinafter with reference to FIGS. 3-5. Thereafter, lamp 82 illuminates photoconductive belt 20 to remove any residual charge remaining thereon prior to the start of the next successive cycle.

B. The Cleaning Device

Figure 1:
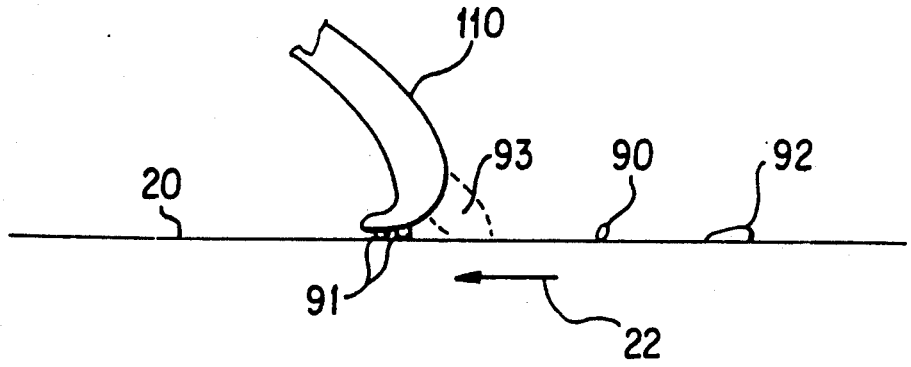
FIG. 1 PRIOR ART
FIG. 1 is an enlarged side view of a cleaning blade/-photoreceptor interface and demonstrates the formation of comets on the photoreceptor.
Figure 4:
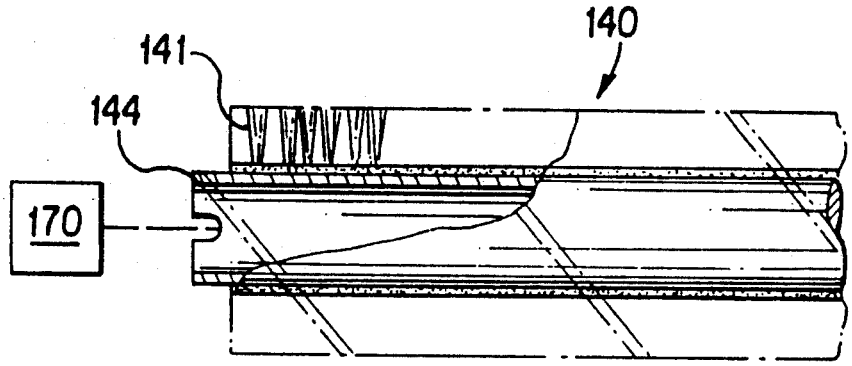
FIG. 4 is an isometric view illustrating a cylindrical cleaning brush according to the present invention.
Figure 5:
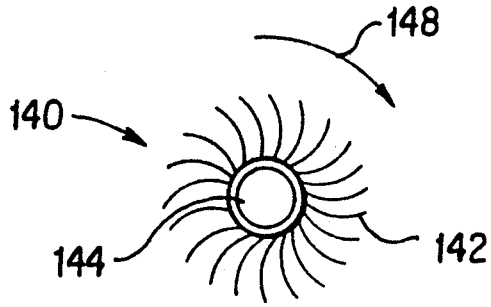
FIG. 5 is a side view of the cleaning brush, and illustrates the direction in which the fibers extend versus the direction in which the cleaning brush rotates.
Figure 3:
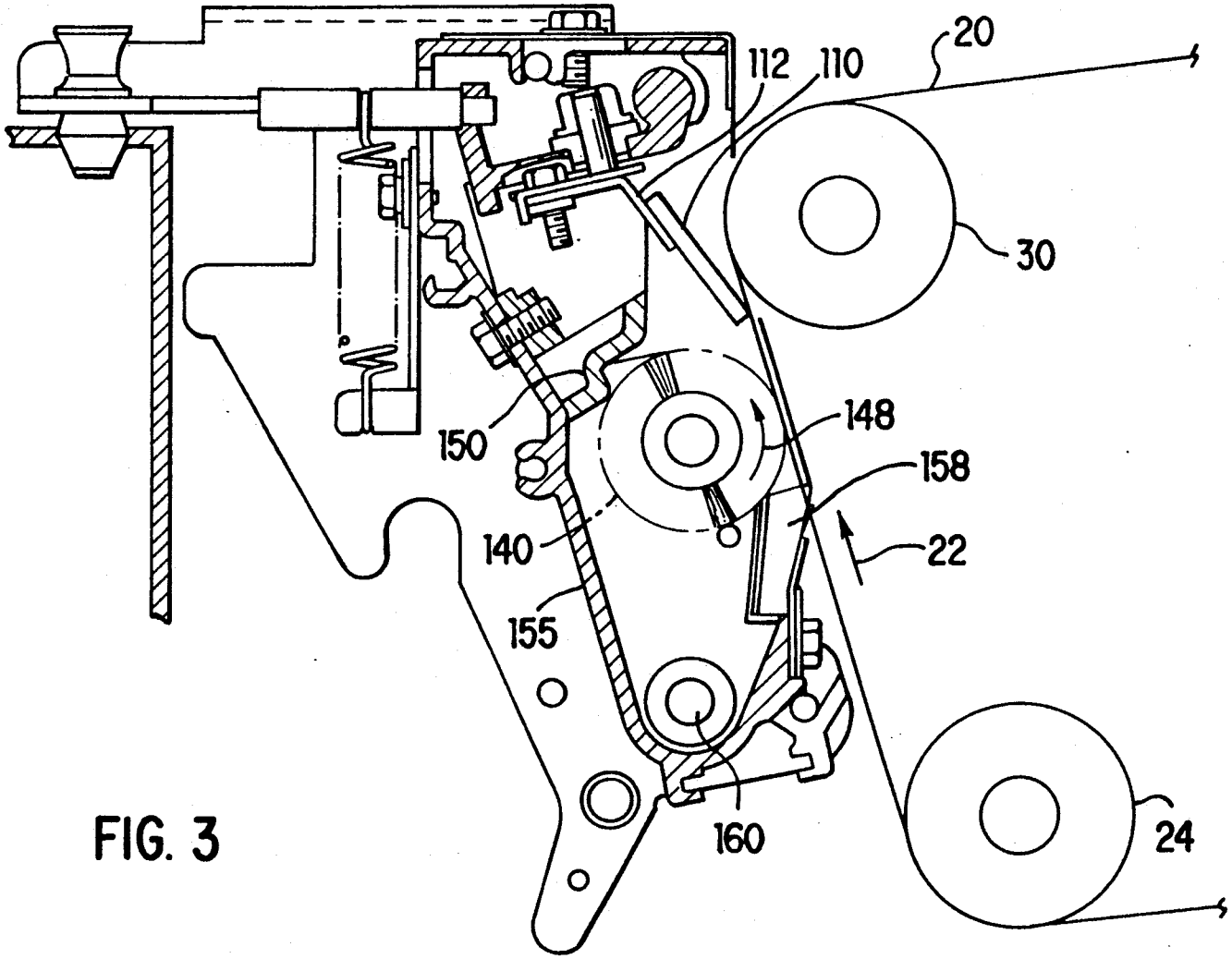
FIG. 3 is an enlarged cross-sectional side view of a cleaning apparatus according to the present invention.

The cleaning device 100 for removing residual toner from photoreceptor 20 is illustrated in FIGS. 3-5. Cleaning device 100 includes a primary cleaner such as, for example, an elongate cleaning blade 110 which removes the majority of residual toner particles from photoreceptor 20. Cleaning blade 110 is mounted to supporting structure by a bracket 112 in a manner similar to previous devices. The cleaning blade 110 is biased against photoreceptor 20 with a force sufficient to remove toner particles from the photoreceptor. As discussed above with reference to FIG. 1, in previous devices, high frictional forces tended to be created at the interface between cleaning blade 110 and the photoreceptor 20. The present invention prevents these high frictional forces from arising by abrading the charge retentive surface of the photoreceptor 20 with a rotating brush 140 located upstream of wiping blade 110 with respect to process direction 22.

Rotating abrading brush 140 extends across the photoreceptor 20 (as does cleaning blade 110) so as to make contact with substantially the entire width of photoreceptor 20. Brush 140 includes a plurality of bristles having a hardness which is greater than a hardness of the charge retentive surface so that the bristles will scratch the charge retentive surface when contacted therewith. It has been determined that the best results are achieved by the present invention when the brush 140 is rotated in the direction (relative to photoreceptor 20) indicated by arrow 148 at a peripheral velocity which is three times that of photoreceptor 20. Additionally, the bristles of the abrading brush 140 should contact the charge retentive surface for a distance of at least 8 millimeters in the process direction.

Preferably, rotating abrading brush 140 is not biased (either electrically or magnetically), and thus, does not attract any of the toner particles from photoreceptor 20. Accordingly, brush 140 is ineffective at removing enough residual toner from photoreceptor 20 to act as a cleaning device. However, it has been found that the scratches formed on the charge retentive surface of photoreceptor 20 are sufficient to reduce the frictional forces between cleaning blade 110 and photoreceptor 20, and thus prevents toner particles from being bonded to the charge retentive surface to prevent comets from forming. The majority of residual toner is removed from photoreceptor 20 by cleaning blade 110 and falls by gravity over and through the rotating abrading brush 140 and collects at a lower portion of housing 155. Housing 155 includes a cleaning member (flicker bar) 150 which contacts rotating abrading brush 140 to remove any toner which may adhere thereto from brush 140 (by flicking the toner from the brush). Additionally, a sealing member 158 is provided upstream of brush 140 to prevent toner particles from scattering outside of housing 155. The removed residual toner can be transported out of housing 155 by, for example, a conventional auger 160.

Cleaning brush 140 can be constructed by spirally wrapping a support sheet having a plurality of bundles 141 of bristles 142 attached thereto (e.g., by weaving) around a shaft 144. The shaft can then be rotated by a separate motor 170, although preferably, the shaft is linked by gears to the motors which rotate photoreceptor 20 so that shaft 144 rotates at the appropriate speed. As shown in FIG. 5, preferably the bristles 142 are curved in a common direction with reference to the rotation direction 148 of shaft 144. The illustrated direction of curvature is preferred because it requires less torque to rotate the brush, and because any toner particles adhered to the bristles are removed more efficiently by flicker bar 150. However, other curvatures or no curvature will also work.

The abrading brush 140 remains effective at sufficiently abrading the photoreceptor as long as the brush does not become clogged with removed toner particles. Accordingly, as stated above, brush 140 preferably is not magnetically or electrically biased. While the arrangement illustrated in FIGS. 2 and 3 is not the most ideal arrangement because toner particles removed by blade 110 fall directly onto brush 140, it has been found that cleaning member 150 maintains brush sufficiently clean to operate satisfactory for extended periods of time. However, an arrangement where removed toner particles did not fall directly onto the abrading brush would result in an even longer brush life.

The speed at which brush 140 is rotated relative to photoreceptor 20 must be such that a sufficient force is imparted to the brush bristles to cause them to scratch the charge retentive surface of the photoreceptor. The length of brush/photoreceptor contact in the process direction affects the size of the scratches formed in the photoreceptor. Although scratch length is not critical, preferably the scratches have a width in the range between 0.050 mm and 0.100 mm, and a depth in the range between 0.0005 mm and 0.002 mm. Additionally, the material which forms the bristles must be harder than the material which forms the charge retentive surface. If the bristles were made from a material softer than the charge retentive layer of the photoreceptor, the bristle material would be deposited on the photoreceptor upon contact therewith. For example, when the outermost layer of the photoreceptor (the charge retentive layer) is made from a mixture of 50% polycarbonate and 50% N,N'-diphenyl-N,N'-bis(3'-methylphenyl)-(1,1'biphenyl)-4,4'-diamine, a brush made from polypropylene bristles having a hardness of 93 on the Rockwell scale is capable of sufficiently scratching the photoreceptor. However, bristles made from a softer material such as polytetrafluoroethylene would not scratch the photoreceptor, and, in fact, would deposit polytetrafluoroethylene on the photoreceptor.

The flexural modulus of the brush bristles is also an important factor. In the above example, the polypropylene bristles had a flexural modulus of 1650 newtons/mm$^2$. Polypropylene bristles with half the flexural modulus would not sufficiently scratch the photoreceptor.

Accordingly, it is not intended to limit the present invention to any of the specific examples provided since the characteristics of the brush bristles will depend on the material which forms the outer layer of the photoreceptor. The characteristic of the present invention which results in the reduction of comets is the amount of photoreceptor scratching which takes place. The photoreceptor must be scratched (abraded) enough to reduce the coefficient of friction between the primary cleaning device (e.g., the cleaning blade) and the photoreceptor, but not so much as to damage the photoreceptor, or to apply so much pressure to the residual toner particles that they melt and adhere to the photoreceptor. In particular, the coefficient of friction between the cleaning blade and the illustrated photoreceptor belt must be maintained at or below 0.9 to prevent toner particles from being adhered thereto. Scratches having a size in the above described range were sufficient to maintain an appropriate coefficient of friction between a blade and a photoreceptor belt having the above described composition.

While it may be possible to construct the photoreceptor belt to have an outer surface which results in a sufficiently low coefficient of friction when pressed against a cleaning blade, this may not be practical due to manufacturing practices. In particular, it is common to use one type of photoreceptor belt in different types of imaging machines (which employ different types of cleaning devices). The illustrative belt may not be subject to cometing when used with a different type of cleaner (i.e., a non-blade cleaner), or with a different type of toner. It may not be desirable to alter the surface characteristics of the belt when used in these different machines. Accordingly, the present invention permits a single type of belt to be used in different machines without altering the belt for each machine.

EXAMPLE

A cleaning device according to the teachings of the present invention was constructed and integrated with a color copier. The copier employed an AMAT belt (wherein a binder generator layer is sandwiched between a support substrate and a charge transport layer). AMAT belts are well known in general, and can be constructed, for example, according to the teachings of U.S. patent application No. 07/618,731, filed Nov. 27, 1990 to Charles C. Robinette et al, the disclosure of which is incorporated herein by reference. The exemplative photoreceptor included four layers. The uppermost outer layer (the charge transport layer) had a thickness of 30 microns and was comprised of a mixture of 50% polycarbonate and 50% N,N'-diphenyl-N,N'-bis(3'-methylphenyl)-(1,1'biphenyl)-4,4'-diamine. The second layer (binder generator layer) had a thickness of 2.3 microns and comprised 7% selenium, 69% vinylcarbazole, and 24% N,N'-diphenyl-N,N'-bis(3'-methylphenyl)(1,1'biphenyl)-4,4'-diamine. The third layer (ground plane) had a thickness of 115 Angstroms and comprised titanium. The fourth layer (back layer) had a thickness of 3 mil and comprised polyethylene.

The cleaning device was constructed according to the following parameters. The blade was a urethane blade having a thickness of 2 millimeters. Such a blade can be purchased from Acushnet Rubber Co., New Bedford, Mass., Xerox material Spec. No. 91-0346. The blade was biased against the photoreceptor with a force of 23 grams per centimeter of length. The abrading brush included a plurality of polypropylene bristles having a length of 7.5 millimeters and a size (diameter) of 17 Denier. The bristles (or fibers) were provided in bundles of 45 fibers per bundle. These bundles were woven into a material (forming a structure resembling a carpet) so that there were 40,000 fibers per square inch. The individual fibers had a flexural modulus of 1,650 newtons per $mm^2$ and a hardness of 93 on the Rockwell scale. This brush was purchased from Tsuchiya Co., Ltd., 4F Fujika Bldg., 2-2-2 Yotsuya, Shinjokuku, Tokyo, Japan. The brush 140 was arranged with respect to the photoreceptor so that the bristles would contact the photoreceptor for at least 8 millimeters in the process direction. The photoreceptor was rotated at a peripheral velocity of 190 mm/sec, and the brush was rotated at a peripheral velocity of 570 mm/sec.

When operated, minute scratches having a length in the range between 3 mm and 7 mm, a width in the range between 0.050 mm and 0.100 mm, and a depth in the range between 0.0005 mm and 0.002 mm were created in the charge retentive surface of the photoreceptor. Whereas comets developed in previous devices in less than 5,000 photoreceptor revolutions, the addition of the brush according to the teachings of the present invention eliminated comets on the photoreceptor for over 100,000 revolutions.

While the present invention is described with reference to a preferred embodiment, this particular embodiment is intended to be illustrative and not limiting. For example, the present invention can be used with imaging systems employing a photoreceptor drum instead of a belt as long as the brush sufficiently scratches the outermost photoreceptor layer. Additionally, the abrading brush of the present invention can be used in combination with primary cleaners other than blades, particularly when the formation of comets is a problem. Various modifications may be made without departing from the spirit and scope of the invention as defined in the appended claims.

What is claimed is:

1. An image forming apparatus for forming images on a recording medium comprising:

a rotating charge retentive surface which rotates in a feeding direction;

means for charging said charge retentive surface;

means, located downstream of said means for charging relative to said feeding direction, for forming a latent image on said charge retentive surface by selectively discharging portions of said charge retentive surface;

means, located downstream of said means for forming a latent image relative to said feeding direction, for applying toner to said charge retentive surface to form a toner image on said charge retentive surface which corresponds to said latent image;

means, located downstream of said means for applying toner relative to said feeding direction, for transferring said toner image to the recording medium;

means, located downstream of said means for transferring, for removing residual toner from said charge retentive surface, said residual toner remaining on said charge retentive surface after transfer of the toner image to the recording medium, said means for removing residual toner including:

a primary cleaner which extends across and contacts said charge retentive surface from a first side to a second side of said charge retentive surface, said primary cleaner removing a majority of the residual toner from said charge retentive surface as said charge retentive surface moves by said primary cleaner;

an elongate rotating abrading brush, located upstream of said primary cleaner relative to said feeding direction and extending across said charge retentive surface substantially parallel to said primary cleaner, said abrading brush including a plurality of bristles having a hardness greater than a hardness of said charge retentive surface, said abrading brush contacting and abrading said charge retentive surface; and means for rotating said abrading brush;

means, located between said means for removing residual toner and said means for charging, for discharging said charge retentive surface; and wherein the hardness of said bristles, an amount of contact between said bristles and said charge retentive surface, and a speed at which said rotating abrading brush is rotated by said means for rotating said abrading brush are sufficient to cause said charge retentive surface to be scratched enough to reduce a coefficient of friction between said primary cleaner and said charge retentive surface so that said coefficient of friction is no greater than 0.9.

2. The apparatus of claim 1, wherein said abrading contacts said charge retentive surface for a distance of at least 8 millimeters in said feeding direction.

3. The apparatus of claim 1, wherein said means for rotating rotates said abrading brush at a peripheral speed at least three times faster than a peripheral speed at which said charge retentive surface is rotated.

4. The apparatus of claim 1, wherein said abrading brush includes bristles made from polypropylene.

5. The apparatus of claim 4, wherein said polypropylene bristles have a hardness of 93 on the Rockwell Scale and a flexural modulus of 1650 newtons/$mm^2$.

6. The apparatus of claim 1, wherein said rotating abrading brush forms scratches in said charge retentive surface having a width in the range between 0.050 mm and 0.100 mm and a depth in the range between 0.0005 mm and 0.002 mm.

7. The apparatus of claim 1, wherein said rotating abrading brush is ineffective in cleaning said charge retentive surface, said primary cleaner removing a majority of said residual toner from said charge retentive surface.

8. The apparatus of claim 1, wherein said charge retentive surface is a photoreceptor belt.

9. The apparatus of claim 1, further comprising a cleaning member which contacts said abrading brush to remove toner particles from said abrading brush.

10. An image forming apparatus for forming images on a recording medium comprising:

a rotating charge retentive surface which rotates in a feeding direction;

means for charging said charge retentive surface;

means, located downstream of said means for charging relative to said feeding direction, for forming a latent image on said charge retentive surface by selectively discharging portions of charge retentive surface;

means, located downstream of said means for forming a latent image relative to said feeding direction, for applying toner to said charge retentive surface to form a toner image on said charge retentive surface which corresponds to said latent image;

means, located downstream of said means for applying toner relative to said feeding direction, for transferring said toner image to the recording medium;

means, located downstream of said means for transferring, for removing residual toner from said charge retentive surface, said residual toner remaining on said charge retentive surface after transfer of the toner image to the recording medium, said means for removing including:

an elongate cleaning blade which extends across and contacts said charge retentive surface, said cleaning blade being biased against said charge retentive surface for scraping and removing a majority of the residual toner from said charge retentive surface as said charge retentive surface moves by said cleaning blade;

an elongate rotating abrading brush, located upstream of said cleaning blade relative to said feeding direction and extending across said charge retentive surface substantially parallel to said cleaning blade, said abrading brush including a plurality of bristles having a hardness greater than a hardness of said charge retentive surface, said abrading brush contacting and abrading said charge retentive surface; and means for rotating said abrading brush;

means, located between said means for removing residual toner and said means for charging, for discharging said charge retentive surface; and wherein the hardness of said bristles, an amount of contact between said bristles and said charge retentive surface, and a speed at which said rotating abrading brush is rotated by said means for rotating said abrading brush are sufficient to cause said charge retentive surface to be scratched enough to reduce a coefficient of friction between said cleaning blade and said charge retentive surface so that said coefficient of friction is not greater than 0.9.

11. The apparatus of claim 10, wherein said abrading brush contacts said charge retentive surface for a distance of at least 8 millimeters in said feeding direction.

12. The apparatus of claim 10, wherein said means for rotating rotates said abrading brush at a peripheral speed at least three times faster than a peripheral speed at which said charge retentive surface is rotated.

13. The apparatus of claim 10, wherein said abrading brush includes bristles made from polypropylene.

14. The apparatus of claim 13, wherein said polypropylene bristles have a hardness of 93 Rockwell Scale and a flexural modulus of 1650 newtons/mm$^2$.

15. The apparatus of claim 10, wherein said charge retentive surface is a photoreceptor belt.

16. The apparatus of claim 10, further comprising a cleaning member which contacts said abrading brush to remove toner particles from said abrading brush.

17. The apparatus of claim 10, wherein said rotating abrading brush forms scratches in said charge retentive surface having a width in the range between 0.050 mm and 0.100 mm, and a depth in the range between 0.0005 mm and 0.002 mm.

18. The apparatus of claim 17, wherein said rotating abrading brush is ineffective in cleaning said charge retentive surface, said primary cleaner removing a majority of said residual toner from said charge retentive surface.

19. An image forming apparatus for forming images on a recording medium comprising:

a rotating charge retentive surface which rotates in a feeding direction;

means for charging said charge retentive surface;

means, located downstream of said means for charging relative to said feeding direction, for forming a latent image on said charge retentive surface by selectively discharging portions of said charge retentive surface;

means, located downstream of said means for forming a latent image relative to said feeding direction, for applying toner to said charge retentive surface to form a toner image on said charge retentive strafe which corresponds to said latent image;

means, located downstream of said means for applying toner relative to said feeding direction, for transferring said toner image to the recording medium;

means, located downstream of said means for transferring, for removing residual toner from said charge retentive surface, said residual toner remaining on said charge retentive surface after transfer of the toner image to the recording medium, said means for removing residual toner including:

a primary cleaner which extends across and contacts said charge retentive surface from a first side to a second side of said charge retentive surface, said primary cleaner removing a majority of the residual toner from said charge retentive surface as said charge retentive surface moves by said primary cleaner;

an elongate rotating abrading brush, located upstream of said primary cleaner relative to said feeding direction and extending across said charge retentive surface substantially parallel to said primary cleaner, said abrading brush contacting and abrading said charge retentive surface; and means for rotating said abrading brush;

means, located between said means for removing residual toner and said means for charging, for discharging said charge retentive surface; and wherein said rotating abrading brush forms scratches in said charge retentive surface having a width in the range between 0.050 mm and 0.100 mm and a depth in the range between 0.0005 mm and 0.002 mm.

20. The apparatus of claim 19, wherein said primary cleaner is an elongate cleaning blade which extends across and contacts said charge retentive surface, said cleaning blade being biased against said charge retentive surface for scraping and removing a majority of the residual toner from said charge retentive surface as said charge retentive surface moves by said cleaning blade.

* * * * *